United States Patent [19]

Slavin et al.

[11] 4,346,269

[45] Aug. 24, 1982

[54] ROTARY SWITCH AND METHOD OF MOUNTING CONTACTS

[75] Inventors: Roy H. Slavin; W. Donald Scharbert, both of Aurora, Ill.

[73] Assignee: Standard Grigsby, Inc., Aurora, Ill.

[21] Appl. No.: 242,597

[22] Filed: Mar. 11, 1981

Related U.S. Application Data

[63] Continuation of Ser. No. 781,511, Mar. 25, 1977, abandoned.

[51] Int. Cl.[3] ..... H01H 9/00; H01H 19/54

[52] U.S. Cl. ..... 200/11 DA; 200/11 G; 200/291; 200/303

[58] Field of Search ..... 200/11 R, 11 A, 11 D, 200/11 DA, 11 G, 11 J, 11 K, 11 TW, 14, 252, 283, 284, 292, 295, 302, 303, 307, 291

[56] References Cited

U.S. PATENT DOCUMENTS

| | | | |
|---|---|---|---|
| 1,504,283 | 8/1924 | Taylor | 200/291 |
| 2,329,442 | 9/1943 | Popp | 200/303 |
| 3,030,460 | 4/1962 | Huetten et al. | 200/11 G |
| 3,242,273 | 3/1966 | Van Der Put | 200/16 B |
| 3,288,949 | 11/1966 | Brown, Jr. | 200/14 X |
| 3,293,382 | 12/1966 | Lewandowski et al. | 200/14 |
| 3,366,751 | 1/1968 | Capellari | 200/11 TW |
| 3,402,491 | 9/1968 | Wagner | 200/11 R X |
| 3,435,167 | 3/1969 | Pfleger | 200/11 TW X |
| 3,558,834 | 1/1971 | Zielke | 200/11 DA |
| 3,560,672 | 2/1971 | Ludlum et al. | 200/291 X |
| 3,624,320 | 11/1971 | Eberhart et al. | 200/16 D |
| 3,655,925 | 4/1972 | Lincoln et al. | 200/11 TW |
| 3,677,096 | 7/1972 | Hatman | 200/291 |
| 3,712,151 | 1/1973 | Diehl | 74/527 |
| 3,719,785 | 3/1973 | Kendall et al. | 200/307 X |
| 3,736,390 | 5/1973 | Lockard | 200/11 DA |
| 4,172,218 | 10/1979 | Sugisaka | 200/11 DA |
| 4,275,279 | 6/1981 | Wagatsuma et al. | 200/11 DA |

FOREIGN PATENT DOCUMENTS

| | | | |
|---|---|---|---|
| 672369 | 11/1964 | Italy | 200/11 D |

*Primary Examiner*—James R. Scott

*Attorney, Agent, or Firm*—Wegner, McCord, Wood & Dalton

[57] ABSTRACT

A rotary switch has a detent mechanism and one or more switch sections. Each switch section has a rotor disc with annular conductive tracks thereon and four sets of stator contacts, two on each side of the rotor shaft and staggered to engage alternate conductive tracks. The switch section housing has two identical parts which snap together, each section carrying two sets of contacts. The stator contacts are mounted between ribs with an interference fit of the contact edges and the rib walls. The contacts are mounted with a set of contacts joined together and then the joining web is severed.

20 Claims, 13 Drawing Figures

ROTARY SWITCH AND METHOD OF MOUNTING CONTACTS

This is a continuation, of application Ser. No. 781,511 filed Mar. 25, 1977 now abandoned.

BACKGROUND OF THE INVENTION

The invention is concerned with the construction and manufacture of an inexpensive rotary switch of small size which has a high switching capability. Several factors contribute to the desired characteristics.

A principal feature is that each switch section has a rotor with annular conductive tracks thereon and four sets of stator contacts, two sets engaging each face of the rotor disc with one set on either side of the rotary shaft on which the disc is mounted. The positions of the contacts are staggered so that they engage alternate annular tracks on the rotor disc. The terminals of all of the contacts extend from a common planar edge of the switch section housing.

Another feature is that the switch section housing is made of two identical parts which may be molded of plastic and are preferably provided with complementary interengaging surfaces which hold the two parts together.

A further feature is that the stator contacts are mounted between ribs of each housing section with the lateral edges of the contacts having an interference fit with the walls of the ribs. More particularly, prongs extending from the lateral edges of the contacts engage the rib walls. Preferably sets of contacts, joined by a web, are assembled with the housing, e.g., pressed between the ribs, and then the web is severed. Guide channels in the rib walls receive the prongs.

Yet another feature is a detent mechanism having a disc with a serrated periphery, mounted on the switch shaft and balls held in engagement with the disc periphery by an arcuate spring that is free to move, distributing wear. The geometry of the serrations and balls affords a large number of angular positions in a small switch, with accurate angular position and crisp operation.

And a further feature is that the switch section (or multiple sections) is secured to the detent mechanism housing by a tie plate which extends through narrow slots in the lateral edges of the housing.

BRIEF DESCRIPTION OF THE DRAWINGS

Further features and advantages of the invention will readily be apparent from the following specification and from the drawings, in which.

DESCRIPTION OF THE PREFERRED EMBODIMENTS

Figures 1, 2, 11, 12, 13:
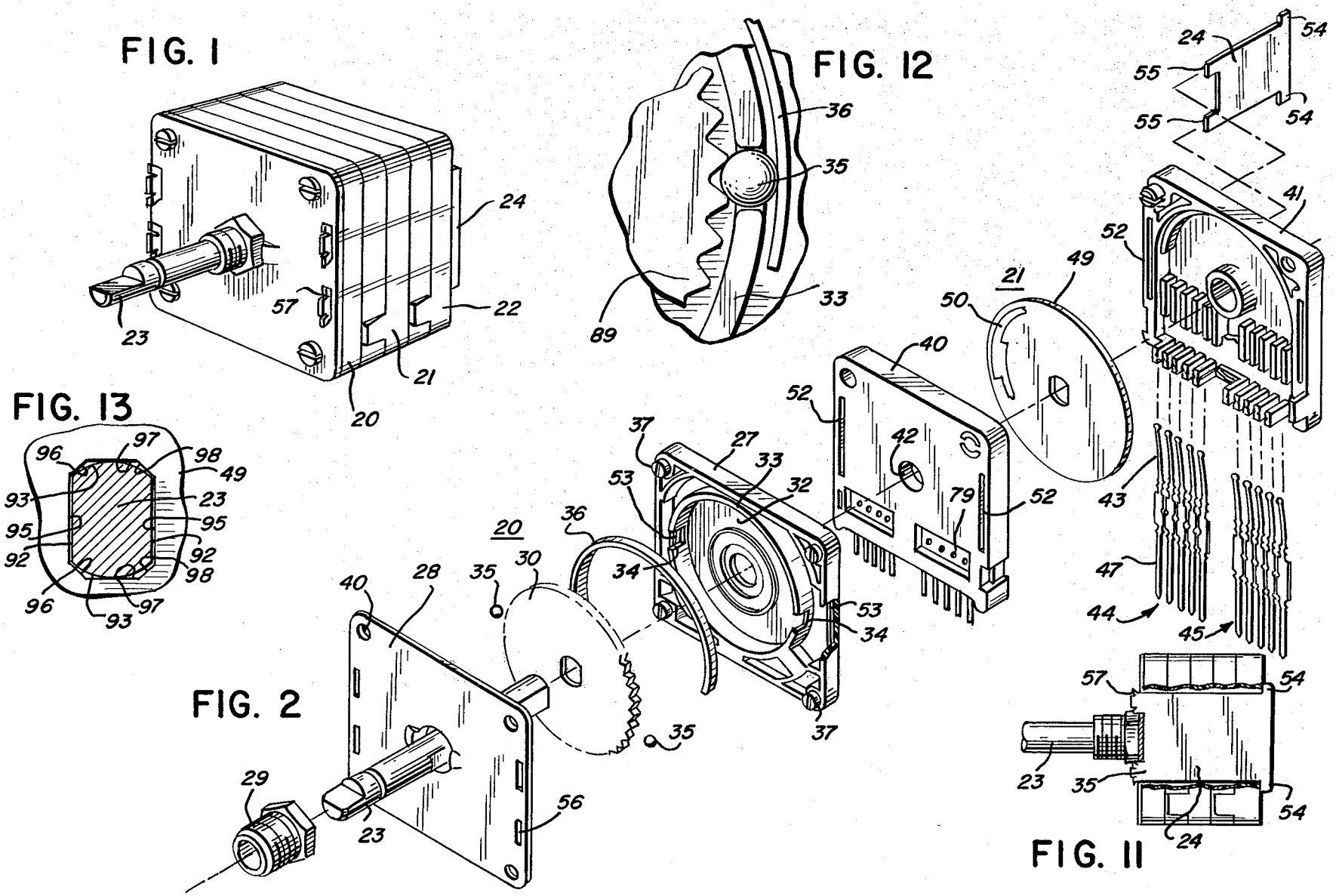
FIG. 1 is a perspective of a switch embodying the invention.
FIG. 2 is an exploded perspective of the detent mechanism and one switch section.
FIG. 11 is a reduced broken side elevation illustrating a tie plate holding switch sections together and to a detent mechanism.
FIG. 12 is an enlarged fragmentary illustration of a portion of the detent mechanism.
FIG. 13 is an enlarged fragmentary illustration of the rotor-shaft interconnection.

The embodiment of the switch illustrated in FIG. 1 has a detent mechanism 20, two switch sections 21, 22 and a shaft 23. The switch sections are held together and to the detent mechanism by two tie plates 24 (one is hidden in FIG. 1). One or more switch sections may be used.

The exploded view of FIG. 2 illustrates many of the novel features of the switch. Detent mechanism 20 has a housing member 26 which may be molded of a suitable material as a thermoplastic sold by General Electric Company under the trademark Valox, or die cast, as of a zinc alloy. A metal cover plate 28 has a threaded bushing 29 secured thereto with the shaft 23 journaled in the bushing. Detent disc 30 is fixed to shaft 23 and has a serrated periphery. The detent disc is nested in a recess 32 in body 27. The wall 33 extending around the recess has a pair of opposed slots 34 receiving detent balls 35 which seat between adjacent teeth of detent disc 30. An arcuate spring 36 outside wall 33 holds the balls 35 against the periphery of detent wheel 30. Balls 35 are diametrically opposed in a switch having an even number of positions. If the switch has an odd number of positions, the balls depart from a diametric relation by one-half the tooth-to-tooth angle. The relationship of the balls is substantially diametric for purposes of this application. Studs 37 at the corners of detent housing body 27 extend through holes 40 in cover plate 28 and are deformed, securing the cover and body together.

Switch section 21 has a housing of two parts 40, 41 which may be molded of Valox plastic. As will appear below, the two housing parts are identical, minimizing mold cost and manufacturing expense. Each housing part is generally rectangular and has a centrally located opening 42 through which shaft 23 extends. Four sets of stator contacts 43 are provided in each switch section, there being two sets carried by each housing part. Only two sets 44 and 45 of contacts are shown in FIG. 2, for mounting in housing part 41. Two similar sets of contacts are mounted in housing part 40. Each of the contacts 43 has a terminal portion 46 which extends outwardly through one wall of the switch section, here identified as the bottom wall. The switch contact terminal portions illustrated are for insertion in a printed circuit board; alternatively, the terminal portions may have an aperture for solder connection of a wire or accept a wrapped connection or otherwise connect the switch in a circuit.

Rotor disc 49 is mounted on shaft 23 and turns with it. The rotor disc is preferably circular and is of a non-conducting material as a printed circuit board laminate. Annular conductive patterns 50 on the rotor surface are engaged by the end portions 46 of stator contacts 43 and effect a desired switching sequence as the rotor is turned. The configuration of conductive patterns 50 and interconnections between adjacent contacts 43 in each contact set establish the switching program for the switch section.

The two halves 40, 41 of the switch section housing are identical. This minimizes component cost and simplifies manufacture. Each switch section may have four sets of stator contacts as will be described in more detail below. The two housing parts snap together for ease of assembly.

The switch sections 21, 22 are held together and to the detent mechanism by a pair of tie plates 24 which extend through slots 52 in the switch housing and 53 in the detent housing. Slots 52 are located in the lateral edges of the housing and the tie plates 24 do not interfere with the terminal portions 47 of contacts 43 extending from the bottom wall of each switch section. Tie plate 24 has a body with projections 54 which engage the rear face of the switch section housing remote from detent mechanism 20, and above and below slot 52. The other end of tie plate 24 has a pair of axially extending legs 55 which project through slots 56 in the metal cover plate 28 of the detent mechanism and are staked thereto as indicated at 56. The length of the body of tie plate 24 is determined by the number of switch sections.

Two sets of stator contacts 44, 45 are mounted in each switch section housing part. The contacts 43 in each set are staggered from the center line of shaft 23 so that the contacts in the two sets engage alternate annular tracks on the rotor disc 49. As the two housing parts are identical, the contacts in each housing part are also staggered with respect to the opposed contacts in the other housing part. This provides lateral separation between the contact terminal portions 47 so that physical separation of the connections to the terminal portions is maximized. Stator contacts 43 have resilient cantilevered portions 60 terminating in rounded contact surfaces 61 which engage the annular conductive tracks of rotor 49. Contact surfaces 61 are preferably aligned along a diameter of rotor disc 49 at right angles to the axes of the stator contacts. The stator contacts are tangent to the conductive patterns of the rotor affording maximum separation between the tracks.

Figure 7:
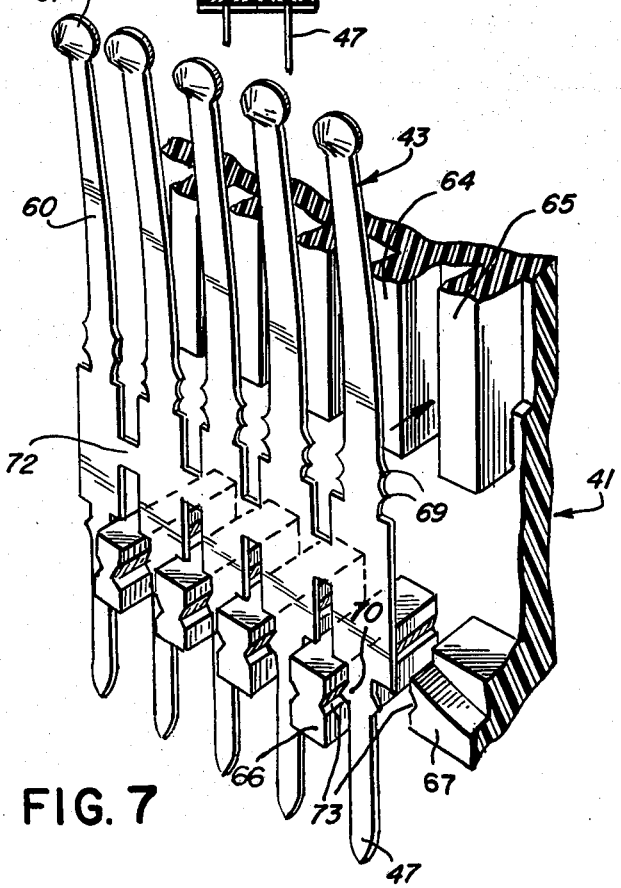
FIG. 7 is an enlarged fragmentary perspective illustrating assembly of a set of stator contacts with a switch housing.

Each contact 43 is mounted between a pair of laterally spaced, axially extending ribs, as ribs 64, 65, and each rib has spaced portions 66, 67, respectively, FIG. 7. A set 44, 45 of five contacts requires six mounting ribs. Contact 43 has a pair of prongs 69 extending outwardly from both edges at the base of cantilever portion 60. A single prong 70 extends outwardly from each edge adjacent the base of terminal portion 47. The prongs 69, 70 have an interference fit with the facing walls of ribs 64, 65 and 66, 67 holding the contact securely in place.

Each set of stator contacts, as 44, 45, is preferably mounted in the stator housing with the contacts joined together by a web 72 located between the mounting prongs 69, 70. The facing walls of ribs 64, 65 and 66, 67 are tapered so that the spacing between the ribs is less at the base than at their outer ends. Ribs 66, 67 extend above ribs 64, 65 and the walls have guide channels 73 which receive prongs 70. The contacts of a set are aligned with the spaces between the ribs and pressed into position. Guide channels 73 and prongs 70 provide positive positioning of the contact set. The web 72 is then severed, separating the contacts.

Figure 8:
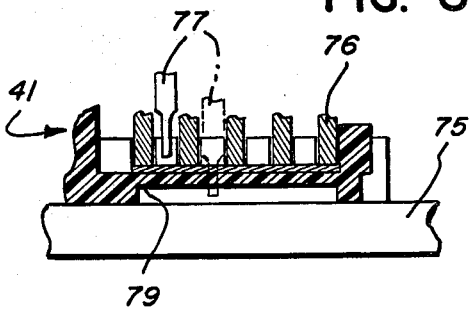
FIG. 8 is a fragmentary section illustrating an apparatus for assembling a set of contacts with a housing part and for cutting the web which joins the contacts.

Tooling for mounting and severing the contacts is illustrated diagrammatically in FIG. 8. Housing part 41 is placed on lower plate 75 of a press. Switch housing part 41 is placed on plate 75 and a set 44 of switch contacts is aligned with the spaces between the ribs with prongs 70 started in guide channels 73, as shown in FIG. 7. The reciprocating upper plate of the press, not shown, carries bars 76 which engage each of the contacts, extending axially of the contact at least from prongs 69 to 70, and which as the press plate descends forces the set of contacts between the ribs, as 64, 65, 66, 67, to seat the set of contacts against the inner surface of the housing wall. Further downward movement of the upper press plate moves the cutters 77 from the solid line position to the broken line position, severing the web 72 between adjacent contacts and piercing the housing wall. Metal and plastic scrap cut from the switch is carried outside the housing part by the cutters. The housing wall has an area 79 of reduced thickness adjacent web 72 to facilitate cutting. The two sets 44, 45 of contacts are thus mounted in a housing part and separated in one press operation. Contact assembly and separation may be performed in successive steps if desired.

The switching program may make it desirable that one or more stator contacts be connected together. This may be accomplished by omitting one of the cutters 77.

Figure 9:
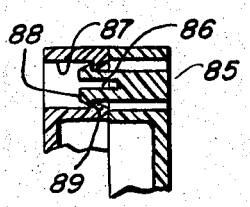
FIG. 9 is a fragmentary section taken along line 9—9 of FIG. 3.
Figure 10:
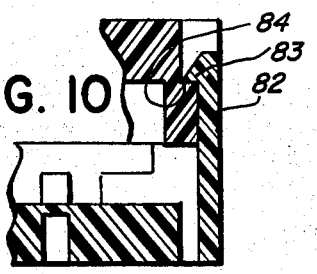
FIG. 10 is a fragmentary section taken along line 10—10 of FIG. 3.
Figure 5:
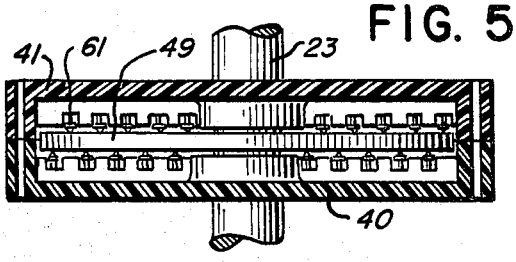
FIG. 5 is a horizontal section through a switch section looking down along line 5—5 of FIG. 3.
Figure 4:
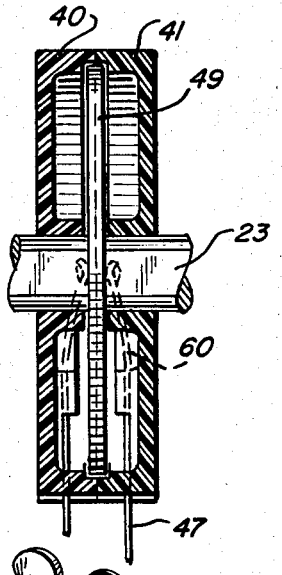
FIG. 4 is a vertical section through a switch section taken generally along line 4—4 of FIG. 3.
Figure 3:
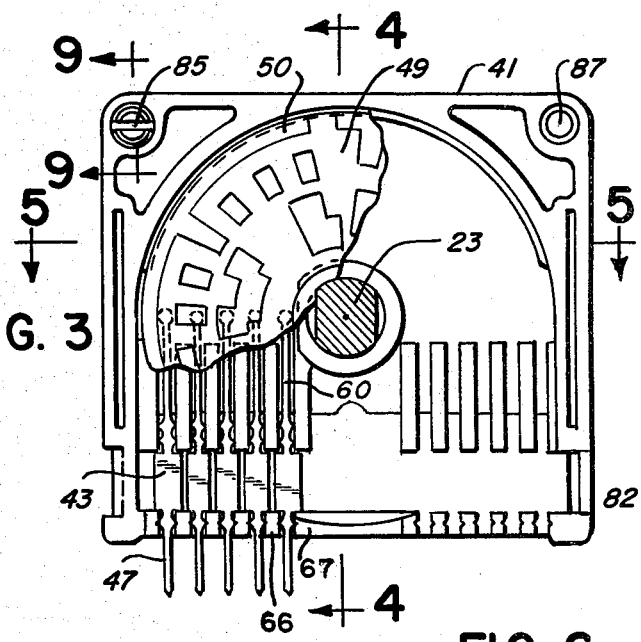
FIG. 3 is a vertical section through a switch section on a plane transverse to the axis of the shaft, showing the face of one-half of the housing with contacts on only one side thereof and showing a broken portion of a rotor disc.
Figure 6:
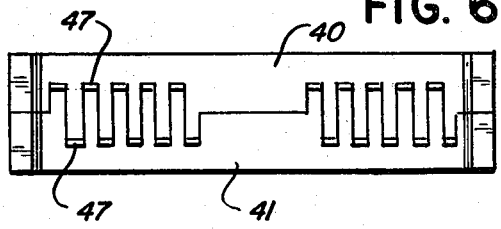
FIG. 6 is a bottom plan of a switch section.

The housing parts 40, 41 have complementary interlocking surfaces which hold them together. These are best illustrated in FIGS. 3, 9 and 10. An outwardly flexible flap 82 is provided on a lateral edge of the housing adjacent the bottom planar edge. Flap 82 has a lip 83 which engages a recessed shoulder 84 on the other lateral edge of the housing part. One upper corner of the housing has an axially extending plug 85 with a bifurcated flexible end portion 86 received in a hole 87 at the other corner of the housing part. Outwardly extending lips 88 on the legs 86 of plug 85 engage an inwardly extending shoulder 89 in hole 87, FIG. 9. The resilient, flexible surfaces on the two parts snap together to assemble a switch section with a simple operation and without separate fasteners.

The capacity of the disclosed switch construction for high density switching is illustrated by considering a specific switch embodiment. The dimensions given are illustrative of a practical switch. Features of the invention may be used in switches of other sizes and with different numbers of stator contacts and switch positions.

A switch section housing 40, 41 having outside dimensions of 1.625 inch wide by 1.500 inch high and 0.400 inch thick accommodates 20 stator contacts spaced laterally on centers of 0.1 inch in two rows spaced axially 0.2 inch. The switch may have up to 60 positions. In this switch the shaft 23 has a diameter of 0.25 inch and the rotor 49 has a diameter of 0.7 inch. Each of the five contacts 43 in a set has center-to-center spacing of 0.1 inch. The cantilever portion 60 of each contact is tapered from 0.03 inch to 0.025 inch at the contact end. The point-to-point width of the prongs of the contact is 0.049 inch with a spacing of the ribs at their base of 0.048 inch. The height of ribs 66, 67 is 0.2 inch with the spacing between them tapering from a maximum of 0.056 inch to 0.048 inch. Grooves 73 have a depth of 0.005 inch and the grooves terminate 0.044 inch above the rib base.

The mechanical design of the detent mechanism determines the number of positions of the switch. With the switch described above and detent balls 35 having a diameter of 0.093 inch a range of positions up to 60 is feasible. Detent housing slot 34 has a width of 0.094 inch. For switches with 50, 55 or 60 positions, detent disc 30 has an outside diameter of 1.250 inch with teeth 89 having depth of 0.03 inch, FIG. 12. The valley radius between is 0.015 inch. The peak radius for each tooth is 0.01 inch. For a 40 position switch, the outside diameter of the disc is 0.96 inch with a tooth depth of 0.0235 inch and a valley radius of 0.025 inch. The torque required to turn the switch is a function of several factors including the ball diameter, the strength of spring 36, the tooth angle and the tooth peak radius.

The shaft 23 has a typical double D cross section with two opposed, spaced parallel flat side walls and two opposed, spaced arcuate end walls. In assembly of the switch, a rotor section 49 is slipped over the end of shaft 23. It has been common in such switches that the rotor has a hole with edges which mate with both the flat and arcuate wall surfaces of the shaft. We have found that if care is not used in the alignment of the rotor disc and shaft before assembly, the corners of the shaft deform or broach the corners of the hole in the rotor, resulting in angular play between the shaft and rotor disc. This condition is not serious in a switch having a limited number of positions. However, in the switch disclosed herein having 50 or 60 positions with a 10-track rotor which is less than an inch and a half in diameter, an angular misalignment of even a few degrees results in incorrect switching and does not meet permissible tolerances.

FIG. 13 illustrates a preferred rotor construction which minimizes this assembly problem. Shaft 23 has a double D cross section. The shaft surface is defined by two opposed, spaced parallel flat side surfaces 92 and two opposed spaced arcuate end surfaces 93. The shaft opening in rotor 49 has a pair of straight opposed edges 95 which are parallel with each other and which mate with the flat side surfaces 92 of shaft 23. The ends of the opening in the rotor, rather than having an arcuate configuration mating with the rotor shaft, are each made up of sets of three straight edge sections 96, 97 and 98. Each center edge section 97 engages an arcuate end surface 93 of the rotor shaft. The enlarged opening in the rotor facilitates mounting of the rotor on the shaft 23 and positions the rotor angularly and laterally with respect to the shaft while minimizing deformation of the rotor hole edges during assembly.

I claim:

1. A switch assembly comprising:

a first electrically insulative cover plate having a hole therethrough;

first means for retaining a plurality of contacts in spaced relation on said first cover plate said first retaining means including a plurality of first projections extending perpendicularly from an edge portion of said first cover plate and spaced from one another;

a second electrically insulative cover plate adapted to fit in parallel relation with said first cover plate;

second means for retaining a plurality of contacts in spaced relation on said second cover plate, said second retaining means including a plurality of second projections extending perpendicularly from an edge portion of said second cover plate and spaced from one another, said second projections being offset from said first projections so as to interfit therewith;

a plurality of longitudinally extending first electrical contacts retained by said first retaining means, each of said first contacts lying between respective first projections and engaged by the second projection interfitting therebetween;

a plurality of longitudinally extending second electrical contacts retained by said first retaining means, each of said second contacts lying between respective second projections and engaged by the first projection interfitting therebetween;

a rotor shaft rotatably and supportedly extending through said hole;

a rotor disc mounted on the rotor shaft for rotation therewith, said disc having first and second electrically conductive patterns formed on opposite sides thereof, respectively; and means for fastening the first and second cover plates together in parallel relations with the rotor disc disposed between said first and second contacts so that said first contacts operatively engage said first pattern and said second contacts operatively engage said second pattern.

2. A switch assembly comprising:

a first electrically insulative housing member having a hole therethrough;

first means for retaining a plurality of contacts in spaced relation on said first housing member, said first retaining means including a plurality of first projections extending outwardly from an edge portion of said first housing member and spaced from one another;

a second electrically insulative housing member adapted to fit in parallel relation with said fist housing member;

second means for retaining a plurality of contacts in spaced relation on said second housing member, said second retaining means including a plurality of second projections extending outwardly from an edge portion of said second housing member and spaced from one another, said second projections being offset from said first projections so as to interfit therewith;

a plurality of longitudinally extending first electrical contacts retained by said first retaining means each of said first contacts lying between respective first projections with one of the second projections interfitting therebetween;

a plurality of longitudinally extending second electrical contacts retained by said second retaining means, each of said second contacts lying between respective second projections with one of the first projections interfitting therebetween;

a rotor shaft rotatably extending through said hole;

a rotor disc mounted on the rotor shaft for rotation therewith, said disc having first and second electrically conductive patterns formed on opposite sides thereof, respectively; and means for fastening the first and second housing members together in parallel relation with the rotor disc disposed between said first and second contacts so that said second contacts operatively engage said second pattern.

3. A rotary switch, comprising:

a rotary shaft;

a detent mechanism operably connected with said shaft;

an individual enclosed rectangular housing for said detent mechanism;

at least one switch section including an individual enclosed rectangular housing having planar edges, with electrical stator conductors and electrical rotor conductors therein, said shaft extending through the switch section housing, said stator conductors being mounted on said housing with terminal portions extending outwardly from one edge and said rotor conductors being mounted on said shaft for rotation therewith, the detent housing and the switch section housing each having a pair of elongated axial slots parallel with and adjacent to the lateral edges on either side of said one edge, the slots in each housing forming sets of aligned slots with the housing in abutting relationship; and two tie plates, one extending axially through each set of aligned slots, securing the switch section to the detent mechanism.

4. The rotary switch of claim 3 in which one end of each tie plate has a projection which engages a surface of a housing and the other end has an axial extension secured to the surface of the other housing.

5. The rotary switch of claim 4 in which the cover plate of the detent mechanism housing is metal and is remote from the adjacent switch section housing and the tie plates each have a leg extending through the metal plate and staked thereto.

6. A rotary switch, comprising:

a rotary shaft;

a detent mechanism operably connected with said shaft;

an enclosed housing for said detent mechanism;

at least one switch section including an enclosed housing with said shaft extending generally through the center thereof;

a circular rotor disc of insulating material mounted on said shaft;

annular conductive patterns on said rotor disc, four sets of leaf contacts cantilever mounted in said housing, two sets engaging each face of the disc with one set on each side of said rotor shaft, said stator contacts having terminal portions extending outwardly from one edge of said housing; and a pair of tie plates extending through axially aligned elongated slots in two other edges of said switch section housing and said detect mechanism housing securing the switch section housing in abutting relation to the detent mechanism housing.

7. A rotary switch section comprising:

a housing of resilient, nonconductive material, having two interfitting substantially identical parts, each part forming half of said housing and having a generally planar edge with means adjacent thereto for receiving a plurality of stator contacts, a central opening to receive a rotor shaft, contacts mounted in said receiving means with terminal portions extending outwardly through the planar edge of said housing, the contacts on one side of said opening being staggered with respect to contacts on the other side thereof, surfaces on each part interlocking with complementary surfaces on the other to hold the two housing parts together; and a rotor of nonconductive material in the housing between the housing parts, and having annular conductive switching tracks thereon to engage said contacts on rotation by a shaft extending through said central opening.

8. The rotary switch section of claim 7 in which at least one of each set of complementary interlocking surfaces is resiliently flexible whereby said interfitting parts are readily assembled.

9. The rotary switch section of claim 8 in which one set of complementary interlocking surfaces includes an outwardly flexible flap on one edge of said housing part adjacent said planar edge.

10. The rotary switch section of claim 8 in which one set of complementary interlocking surfaces includes a bifurcated axially extending plug and a complementary hole in said housing parts remote from said planar edge.

11. The rotary switch housing of claim 8 in which the complementary interlocking surfaces includes an outwardly flexible flap on one edge of said housing part adjacent said planar edge and a bifurcated axially extended plug and a complementary hole in said housing parts remote from said planar edge.

12. The rotary switch section of claim 7 in which said receiving means comprises laterally spaced axially extending ribs between which said stator contacts terminal portions are received, the ribs of the assembled housing parts interleaving.

13. In a rotary switch having a rotatable shaft with a double D cross section defined by two opposed, spaced, parallel flat side surfaces and two opposed, spaced arcuate end surfaces, and a switch rotor of insulating material received on said shaft, the improvement comprising:

means defining a shaft receiving opening through the center of said rotor, said means including a pair of straight spaced opposed parallel edges mating with the flat side surfaces of said shaft and two opposed sets of plural straight edge sections, one set at each end of the opposed straight edges, at least one edge section of each set engaging an arcuate end surface of the shaft.

14. The switch rotor of claim 13 in which each set of straight edge sections has three straight sections, the center section of each set being at right angles to said pair of parallel opposed edges and engaging the center of an arcuate end surface of the shaft.

15. In a rotary switch having a rotary shaft, a detent mechanism operably connected with said shaft and at least one switch section including a housing the improved switch mechanism comprising:

a rotor disc of insulating material mounted on said shaft, with annular conductive areas thereon; and a plurality of stator conductor leaf contacts cantilever mounted on said housing, said stator contacts being in four sets, two sets contacting each face of the rotor disc with one of said two sets on each side of said rotor shaft.

16. The rotary switch of claim 15 in which each of said sets of stator contacts has plural contacts and the contacts of the two sets of contacts associated with one face of said rotor disc engage alternate annular conductive areas thereon.

17. The rotary switch of claim 16 in which the disc engaging surfaces of the contacts in the two sets on one side of the disc are aligned generally along a diameter of the disc and the spacing from the shaft of the contacts in one set is staggered with respect to the spacing of the contacts in the other set.

18. The rotary switch of claim 15 in which said housing is rectangular with said shaft extending generally through the center thereof and in which said stator contacts have terminal portions extending outwardly from one edge of said housing.

19. The rotary switch of claim 18 in which the terminal portions of the stator contacts of the two sets of contacts on one side of said rotor disc are axially spaced from the terminal portions of the two sets of stator contacts on the opposite side.

20. The rotary shaft of claim 19 in which the terminal portions of the stator contacts of adjacent sets of contacts on opposite sides of the rotor disc are staggered in spacing from said shaft.

* * * * *